United States Patent [19]

Lodrick

[11] 4,221,289

[45] Sep. 9, 1980

[54] MATCH PACKAGING

[76] Inventor: Lawrence E. Lodrick, 2436 Harrison Ave. N., Rochester, Mich. 48063

[21] Appl. No.: 17,081

[22] Filed: Mar. 5, 1979

[51] Int. Cl.[2] ..... A24F 27/20; A24F 27/26

[52] U.S. Cl. ..... 206/98; 206/108

[58] Field of Search ..... 206/98–100, 206/106, 108–109, 110

[56] References Cited

U.S. PATENT DOCUMENTS

| | | | |
|---|---|---|---|
| 1,351,241 | 8/1920 | Graham | 206/98 |
| 1,824,404 | 9/1931 | Moriya | 206/100 |
| 1,912,957 | 6/1933 | Whitlock | 206/99 |
| 1,942,300 | 1/1934 | Lerch | 206/100 |
| 2,097,839 | 11/1937 | Leukhardt | 206/99 |
| 2,104,464 | 1/1938 | Klassen | 206/110 X |
| 2,139,036 | 12/1938 | Pullen | 206/98 |
| 2,344,059 | 3/1944 | Pullen | 206/98 |
| 2,964,168 | 12/1960 | Herman | 206/99 |
| 4,053,048 | 10/1977 | Cohn | 206/106 |
| 4,058,208 | 11/1977 | Lund | 206/109 |

FOREIGN PATENT DOCUMENTS

| | | | |
|---|---|---|---|
| 58879 | 12/1912 | Austria | 206/100 |
| 2021717 | 11/1971 | Fed. Rep. of Germany | 206/100 |
| 12217 | of 1909 | United Kingdom | 206/98 |

*Primary Examiner*—Herbert F. Ross

*Attorney, Agent, or Firm*—Basile, Weintraub & Hanlon

[57] ABSTRACT

The invention refers substantially to Matches and their packaging therein, with further refinements being to insure safe utilization of the packaged matches. All relevant safety features are utilized in conjunction with the use and application of these matches.

The matches are isolated from each other and substantially isolated from the striker until certain operations are performed, this necessitates, on the part of the user, certain preliminary actions which are substantially inobservant to the young or unsophisticated mentality. The necessity of performing these operations substantially reduce the adverse use of these packaged matches.

7 Claims, 18 Drawing Figures

MATCH PACKAGING

BACKGROUND OF THE INVENTION

I. Field of the Invention

The present invention relates to matches and their packaging composed of the box or book and combinations thereof. More particularly, the present invention relates to methods of striking upon withdrawal of the match and prevention of ignition with inept usage.

II. Description of the Prior Art

Matches and their packaging composed of the box or book and combinations thereof have spawned the present book known to most of us. This classic match book has remained relatively unchanged throughout the years; however attempts have been made to provide variations of the book to improve its potential safety value.

The prior art includes the following U.S. Pat. Nos. 216,501; 233,803; 271,580; 281,075; 540,022; 725,791; 1,154,586; 1,646,229; 1,763,763; 2,140,241; 2,160,180; 2,331,495; 3,225,868 and 4,058,208

The above listed patents disclose a variety of convenient means for packaging and striking matches, but none disclose the safety features plus convenience of the present invention.

SUMMARY OF THE INVENTION

The present invention relates to matches in general and more specifically to match packaging commenserate with ease of production and safe utilization.

A broad object of the invention is to provide a match package which has certain novel features of construction and operation that enhance its utilization and safety value.

A more specific object of the invention is to provide a match package of the character described in which each match is substantially isolated from its neighbor.

A further object of the invention is to provide, with proper pressure and pull, the easy igniting of each individual match upon its withdrawal from its package or container.

A further object of the invention is to provide a means to substantially isolate the match tip from the striker to prevent ignition upon inept handling of match removal.

Another object of the invention is to provide a match and its package of the character described wherein the match must be bent before pulling in order to achieve ignition.

Another embodiment of the invention provides a match and its package wherein the match must be twisted before ignition is achieved.

A third embodiment of the invention provides a match and its package wherein the match and package must be grasped in the proper fashion with more than childhood pressure to achieve ignition.

A fourth embodiment of the invention provides a match and its package wherein placed substantially between successive layers of matches there is a variable striker pattern associated with numbered matches in specific sequences.

A fifth embodiment of the invention provides a match package wherein the pockets and the match therein are placed on a geometric or radial pattern, with preset selected striker sequence, with only one match striking at any one time.

Other objects advantages and applications of the present invention will become apparant to those skilled in the art of match containers when the accompanying descriptions of the best mode contemplated for practicing the inventions is read in conjunction with the accompanying drawing.

The description herein makes reference to the accompanying drawing wherein like numbers refer to like parts throughout the several views and wherein.

DESCRIPTION OF THE PREFERRED EMBODIMENT

Figure 1:
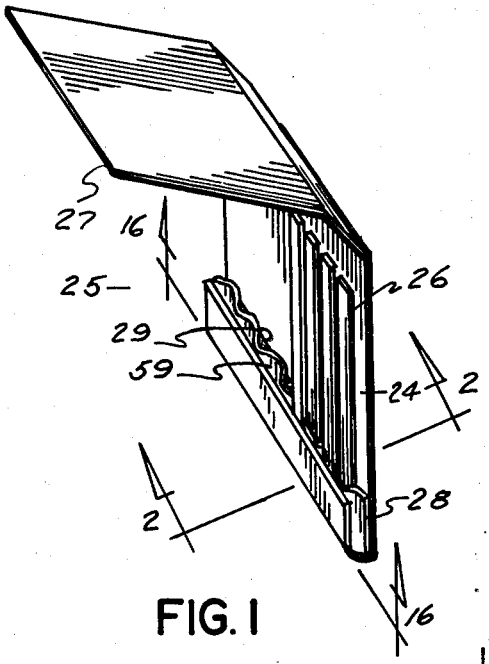
FIG. 1 is a perspective view of an embodiment of the inventions wherein the match must be bent then withdrawn to achieve ignition.
Figure 4:
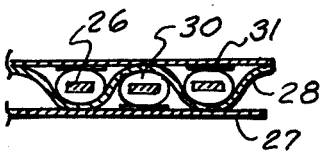
FIG. 4 is a cross sectional view along line 4—4 of FIG. 2.
Figure 2:
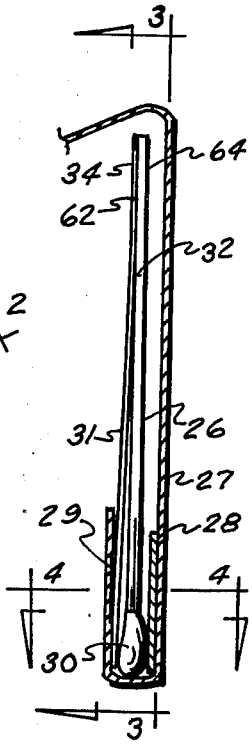
FIG. 2 is a cross sectional view of the match in FIG. 1 taken along line 2—2 of FIG. 1.
Figure 5:
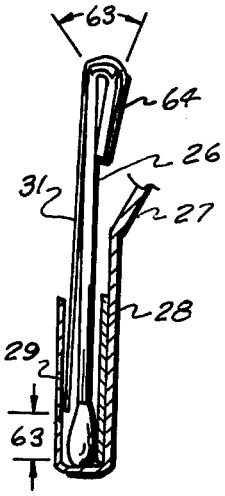
FIG. 5 is a cross sectional view showing barrier removal through the bending of the match stem taken along line 2—2 of FIG. 1.
Figure 3:
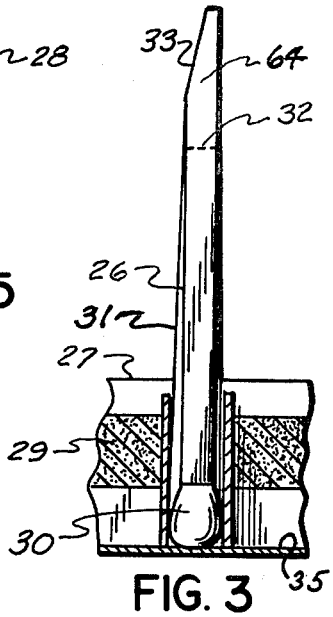
FIG. 3 is a view along line 3—3 of FIG. 2.

Referring now to the drawings and in particular FIGS. 1 through 5, the present embodiment of the match container 25 will be seen to comprise a piece of cardboard 27 bent in such a manner as to wrap around a cardboard separator 28 and is attached thereto to form substantially isolated pockets 59. Inside these pockets is placed a match 24 consisting of stem 26 and head or tip 30. Also found within the confines of said pockets 59 is striker material 29 which was previously applied in the proper position upon cardboard 27 to necessitate match tip 30 sliding over said striker material 29 upon removal of match 24 from pocket 59.

Adequate contact between tip 30 and striker 29 for ignition may be achieved when the container 25 is squeezed with sufficient force to achieve collapse of match separator 28. The match 24 is held within the pocket 59 by having its head 30 adhere in a breakaway fashion at 61 to seal substance 35, FIG. 3. It is also evident that sufficient force between match tip 30 and striker 29 to facilitate ignition can be achieved through proper construction of container 25 so as to squeezingly retain tip 30 and hold tip 30 against striker 29 upon withdrawal.

A further modification of the invention resides in the addition of an adequately sized piece of paper, film, foil or the like 31 attached to match stem 26 at position 62 which provides a barrier or strip between match tip 30 and striker 29. When match 24 is pulled from pocket 59 over said striker 29, film 31 prohibits development of sufficient friction heat for ignition. Positioned between tip 30 and attachment point 62 is score 32. Said score is to a depth of approximately one half the thickness of stem 26 and located a sufficient distance from tip 30 to permit adequate grasping when the portion above score 32 is eliminated. Ignition is achieved by subbstantially removing the strip of barrier 31 from between tip and striker. Grasping match stem 26 at position 64 and proceeding to bend in a direction away from score 32 creates the condition shown in FIG. 5. As can be seen, upon being bent, match stem 26, because of score 32, is required to move through a greater distance on the side to which film 31 is attached, thus the translation motion 63 of film 31 is sufficient to expose tip 30. Grasping match stem 26 while bent and pulling as described previously achieves ignition.

Figure 6:
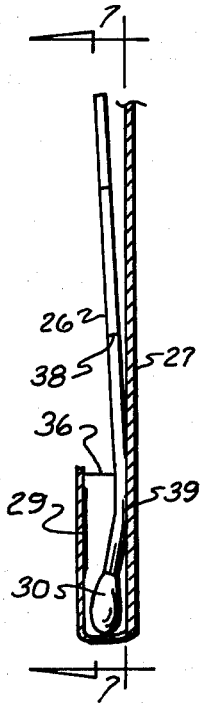
FIG. 6 is a cross sectional view of the second embodiment of the match book taken along line 2—2 of FIG. 1.
Figure 7:
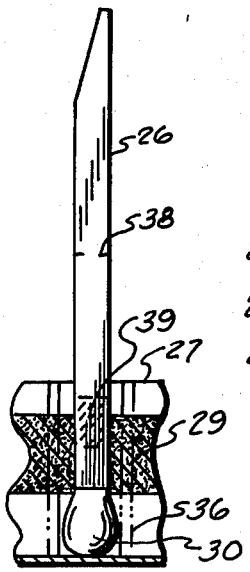
FIG. 7 is a cross sectional view taken along line 7—7 of FIG. 6.

Referring now to FIG. 6 and FIG. 7, another embodiment of the invention will be described as having substantially the same attributes as those described previously with the following modifications. Match stem 26 is substantially cut at point 38 reducing cross sectional area sufficiently to allow separation of stem 26 at point 38 due to adequate fastening of stem 26 to cardboard 27 at surface 39. When match 24 is grasped improperly, with the cuts at point 38 being between attachment surface 39 (and grasp portion of stem 26), separation takes place at 38 preventing ignition. When match 24 is grasped properly between cuts 38 and tip 30, fastening at 39 sheer strength is not sufficient to prevent removal of match. Separator 36 is of a sufficient imcompressible nature to require more than adolescent squeeze strengths to achieve ignition.

Figure 8:
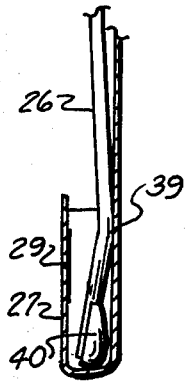
FIG. 8 is a partial cross sectional view of the third embodiment of the match book taken along line 2—2 of FIG. 1.

A further embodiment of the invention shown in FIG. 8 has essentially the same components as mentioned previously with the following modifications.

The match tip 40 is essentially only on one side of match stem 26 preferably away from striker surface 29 and held in this position by being fastened at point 39 to cardboard 27 as mentioned previously. In this instance however match stem 26 must be rotated 180 degrees thus breaking fastening joint 39, now in this new position ignition can be achieved upon withdrawal as mentioned previously. It must be noted that pockets 59 may be of sufficient restrictive size to retain match 65 in its proper initial position requiring adequate torsional force to position head 40 and striker 29 in proper orientation for ignition.

Figure 9:
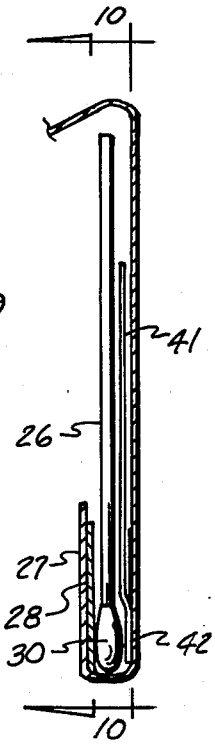
FIG. 9 is a partial cross sectional view of the fourth embodiment of the match book taken along line 2—2 of FIG. 1.
Figure 10:
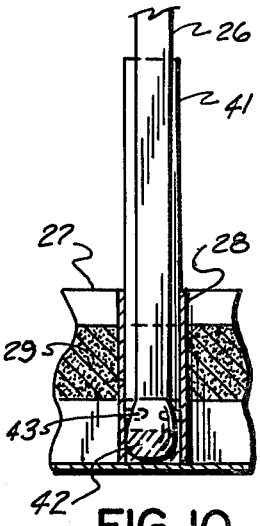
FIG. 10 is a partial cross sectional view taken along line 10—10 of FIG. 9.

Another embodiment of the invention is substantially of the character previously described with the following modifications. As can be seen in FIG. 9 and FIG. 10, a separator strip 41 is placed essentially between the match tip 30 and striker 29 but instead of being attached to match stem 26 is attached at point 42 inside of pocket 59. Match 24 can be withdrawn without ignition until strip 41 is removed exposing striker 29. To insure strip 41 separating at the proper point between tip 30 rest position and striker 29, the cross section of strip 41 is substantially reduced at point 43. When strip 41 is grasped and pulled it separates at point 43 exposing tip 30 to striker 29 thus allowing ignition as previously described.

Figure 11:
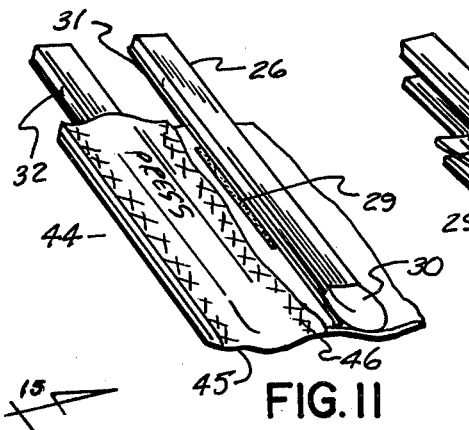
FIG. 11 is a partial pictorial view of a second match packaging procedure.

The match package 44 shown in FIG. 11 possesses essentially all of the features of package 25; the novelty being that it is made of a single piece of foil, paper, plastic or the like 45 having striker 29 placed on its inner surface and said foil 45 being essentially folded in half and glued, embossed or pressure sealed around said match 24 at 46 isolating each match from its neighbor. Utilization of the previously mentioned match tip-striker isolation methods can be employed in this and subsequent embodiments.

Figure 12:
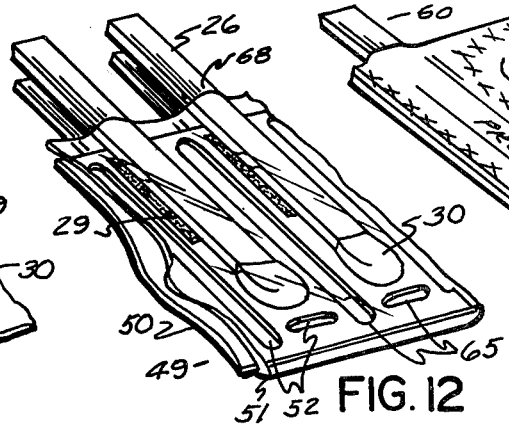
FIG. 12 is a partial pictorial view of a third match packaging procedure.

The embodiment shown in FIG. 12 introduces to the invention another novel feature in which several different virtually imcompatible materials are utilized to construct a match package of one or several adjacent layers of matches. The present embodiment comprises a paper, plastic or the like separator 50 upon which is affixed striker 29, said paper separator 50 being so constructed as to have openings 65 through which a plastic or the like covering 51 can be attached to itself thus containing said separator 50 and match 24. It should also be apparent that separator 50 may have no openings 65 and covering 51 in this condition would be attached or glued directly to separator 50. The plastic covering 51 can be stretched so when a match has be removed the opening through which it came 68 shrinks making reinsertion relatively difficult.

Figure 13:
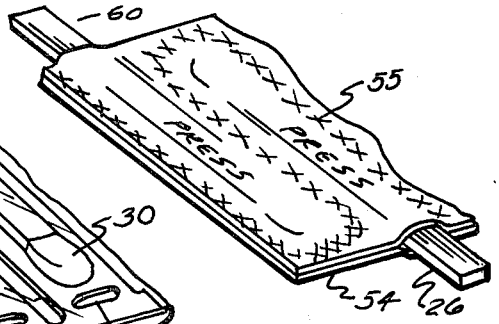
FIG. 13 is a partial pictorial view of a fourth match packaging procedure.
Figure 14:
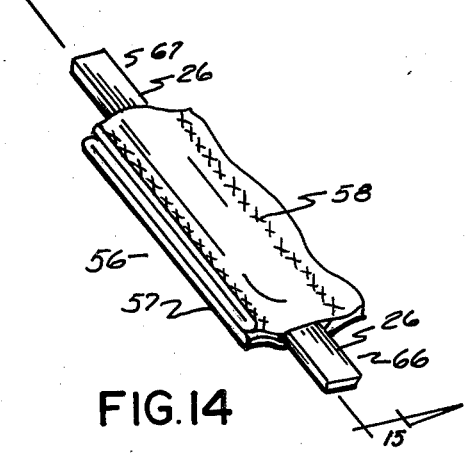
FIG. 14 is a partial pictorial view of a fifth match packaging procedure.
Figure 15:
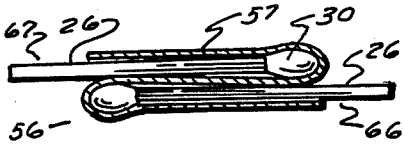
FIG. 15 is a cross sectional view taken along line 15—15 of FIG. 14.

By observing FIG. 13 another feature of the match package becomes evident in that the matches 60 are so positioned as to have match stem 26 in opposing directions. Two pieces of paper, foil or the like 54 having striker 29 in proper position are brought together and fastened, glued, embossed or pressure sealed at 55 to enclose match 24 as shown in FIG. 13. Referring now to FIG. 14 and FIG. 15 we see match package 56 having a plurality of layers achieved by folding covering 57 around match 66 and proceeding further around match 67 or any number of matches so positioned as to expose stem 26 sufficiently for grasping to achieve withdrawal ignition. The aforementioned covering 57 match 66 and 67 placement allows for a straight line seal 58 between successive rows of matches for as many rows as desired with the covering 57 and seal 58 isolating the individual matches from each other.

Figure 16:
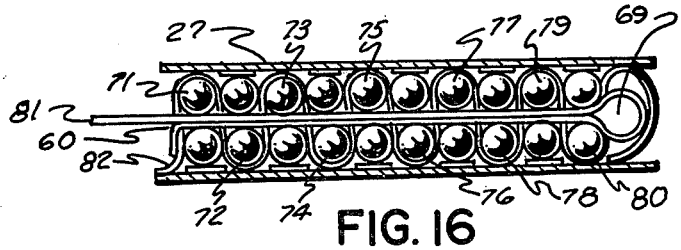
FIG. 16 is an end view section of a sequence ignition match book taken along line 16—16 of FIG. 1.
Figure 17:
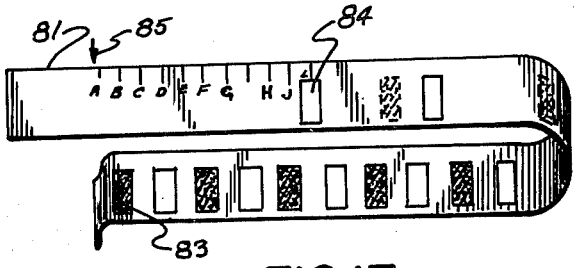
FIG. 17 is a pictorial view of the tape striker.

Yet a still further embodiment of the invention is substantially of the type previously described wih the following modifications. The striker 29 no longer is affixed to cover 27 but is affixed to strip 81 in the manner shown in FIG. 17. The individual squares or areas of striker 29 as at 83 and the openings cut within the strip 81 as at 84 must be brought essentially in line to allow match tip 71, FIG. 16, access to striker 83. This positioning is achieved by pulling strip 81 through openings 60 in match separator 82 sufficiently to align H with arrow 85 thus bringing opening 84 and striker 83 in proper alignment to allow withdrawal ignition of match 71. Of course any number of sequences can be achieved by positioning the openings and striker areas, in different relative positions on said strip 81. To operate or strike the given matches each individual match carries a number on its stem 26 visible upon opening said package and printed on the package cover in a convenient manner is a strike sequence. This sequence and subsequent ignition is achieved by positioning the letters at the arrow and pulling the appropiately numbered match. The sequence is shown as follows:

A at arrow and strike 75
B at arrow and strike 80
C at arrow and strike 76 and 77
E at arrow and strike 73 and 79
F at arrow and strike 78
G at arrow and strike 74
J at arrow and strike 71
L at arrow and strike 72

A further novel feature of this embodiment is that strip 81 is substantially folded back over on itself thus if a small child should remove the strip there essentially would be no striker available to ignite the matches. Also let it be noted that strip 81 could be a roll of paper or the like in opening 69 unrolling as strip 81 is pulled.

Figure 18:
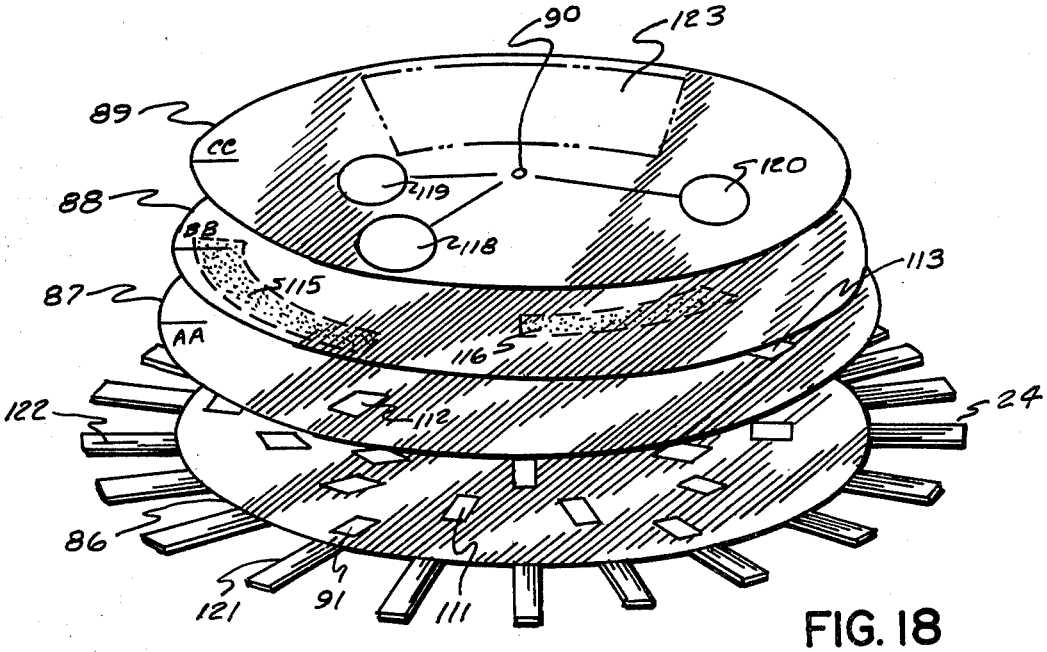
FIG. 18 is an exploded pictorial view of a radial sequence ignition match book.

The concept of isolating the match from its neighbors by the use of the package, and the striker therein from the match tip by use of a barrier between striker and tip has been presented showing the matches substantially in a parallel to each other manner. Within the scope of the invention it should be realized that the pockets and matches therein may be positioned in a radial or geometric fashion if desired. FIG. 18 shows such a radial matchbook consisting substantially of four slightly different diameter concentric wheels 86-87-88 and 89 attached to each other through their centerpoint 90 in such a manner as to allow rotation of each independently of others. Encapsulated as previously described the twenty matches 24 are positioned radially on one side of match disc 86 away from wheel 87 as shown in FIG. 18. Provided in disc 86 are openings 91 through 111 intermitently spaced around and along the withdrawal direction of match 24 in such a manner so as to allow only one opening for each match to traverse upon withdrawal. Positioned in a barrier disc 87 are three openings 112–113 and 114 which when properly oriented will coincide with several (91–111) holes one at a time to allow a striker opening. On strikeable material disc 88 is placed striker material 115, 116 and 117 in such a manner as to allow only one position for the striker to align with openings sufficient for ignition. On a pressure disc 89 is noted several pressure positions 118, 119 and 120. When AA, BB, and CC are lined up with point 122 and squeeze pressure is applied at 118, match 121 can be removed with ignition. However no other matches will be ignited when they are removed. A sequence of where to put AA, BB, and CC to ignite each numbered match will be printed on each package at 123. Of course any number of wheels and/or window striker combinations can be utilized making probabilities quite high against misuse.

Within the preceeding disclosure numerous embodiments of the invention have been set forth with the knowledge that one relatively skilled in the art will see or understand that many, if not all, of the individual concepts can and will be used in conjunction with each other in any of a number of various combinations and partnerships.

It will be understood that within the scope of the details and description set forth various modifications within the spirit and scope of the invention are possible. Therefore the invention is not limited by that which is disclosed except as defined by the appended claims.

I claim:

1. A match package comprising a cardboard cover into which is fastened a separator which defines an isolation pocket for each individual match therein, wherein isolated striker material sections are stragically positioned on a strip containing openings, said strip being attached at one edge of the matchbook then being threaded through slots in the match separator, then being bent and brought back through said slots essentially in contact with itself said openings in the strip needing to be lined up with a particular striker section and the apropriate match before match removal will achieve ignition, said appropriate match being determined from a sequence chart on the package cover in connection with proper positioning of the strip in relation to the edge of the package.

2. A match package of the type including a cardboard cover, an isolation pocket for each individual match, said pocket having sufficient striker material contained therein to facilitate match ignition upon removal of said match from the pocket, the improvement comprising:

a movable strip placed between the ignitable tip of the match and the striker material covering the striker material wherein ignition is achieved only when said strip is removed to provide contact with the striker material prior to withdrawal of the match.

3. The match package as described in claim 2 further comprising:

the strip attached an upper portion of a score match stem;

the score disposed proximate an upper third of the stem; and wherein bending the stem at the score away from a strip side of the stem raises the strip exposing the striker material allowing the match to be ignited upon removal from the pocket.

4. The match package as defined in claim 2, further comprising:

said strip attached within the pocket; and said strip substantially reduced in cross sections between the match tip and striker material insuring strip removal prior to match withdrawal and ignition.

5. The match package as defined in claim 2 further comprising:

said match tip disposed on a side of the stem oriented away from said striker and held in that position by a break away attachment; and said attachment requiring rotation of said match to break attachment and orient tip for proper contact with said striker for withdrawal ignition.

6. The match package as defined in claim 5 further comprising:

said match stem reduced in cross sectional area proximate an upper portion thereof, the reduced area portion having a sheer strength less than the break away attachment strength; and wherein match stem separation instead of ignition occurs upon grasping said stem above said reduced cross sectional area.

7. A match package wherein individual match is isolated from its neighbor in a radial pocket disposed on a match disc, the improvement comprising:

a plurality of openings in the match disc positioned radially to selectively allow each match to traverse an opening upon withdrawal;

a rotatable barrier disc, concentric with and covering the match disc, having openings which selectively uncover openings in the match disc;

a rotatable striker material disc, concentric with and covering the barrier disc, including striker material selectively radially and arcuately disposed to selectively align with the openings uncovered in the match disc;

a rotatable pressure disc, covering and concentric with the striker material disc including indicia showing where pressure will position the striker material to engage a match causing ignition upon withdrawal of the match; and indicia on the discs to indicate arcuate position, indicia to identify the matches, and a sequence chart showing the arcuate position required for each disc to ignite a match upon withdrawal.

* * * * *